United States Patent [19]

Randall

[11] 4,448,133

[45] May 15, 1984

[54] DRAFTING TABLE

[76] Inventor: Paul G. Randall, 11902 Binghamton Dr., Houston, Tex. 77089

[21] Appl. No.: 248,946

[22] Filed: Mar. 30, 1981

[51] Int. Cl.[3] ..... A47F 5/12

[52] U.S. Cl. ..... 108/9; 108/40; 108/79; 108/124

[58] Field of Search ..... 108/40, 124, 9, 68, 108/79

[56] References Cited

U.S. PATENT DOCUMENTS

| | | | |
|---|---|---|---|
| 1,322,385 | 11/1919 | Wilson | 108/40 X |
| 1,524,630 | 1/1925 | Overstedt | 108/124 |
| 1,898,998 | 2/1933 | Glandt | 108/79 |
| 2,103,330 | 12/1937 | LaFetra | 108/124 |
| 2,244,036 | 6/1941 | Williman et al. | 108/9 |
| 2,522,296 | 9/1950 | Overstedt | 108/9 |
| 2,527,056 | 10/1950 | Cain | 108/68 X |
| 3,062,544 | 11/1962 | Viets | 108/40 X |

*Primary Examiner*—Francis K. Zugel

*Attorney, Agent, or Firm*—Kenneth H. Johnson

[57] ABSTRACT

A collapsible drafting table which in the open configuration has the appearance of an attractive contemporary desk and when collapsed, occupies one-fifth the space of the open use configuration. The collapsible drafting table has a rigid central structure which has side panels hingedly attached thereto and a drafting top slidably engaged thereto.

7 Claims, 9 Drawing Figures

10
10a
11
11a
12
13
14
15
16
17
17a
18
18a
18b
19
20
21
22
23
24
25
26
27
29
30
31
33
60
61
62
63
64
66
67
A
A'
B
B'

DRAFTING TABLE

BACKGROUND OF THE INVENTION

1. Field of the Invention

The present invention relates to a drafting table which has the appearance of a desk and which is collapsible for storage and transportation.

2. Related Art

Generally drafting tables are disassemblable for moving and frequently are received in disassembled condition. Other drafting tables are not easily disassembled and once assembled are stored and moved in their fully assembled form. U.S. Pat. No. 4,099,469 shows one type of collapsible drafting table in which the legs telescope in and the drafting top folds up. Another form of storable drafting table is shown in U.S. Pat. No. 2,897,030 which has a drafting top which folds up to cover storage compartments.

The present drafting table has as a feature its appearance, which is much like an ordinary desk. A particular advantage of the present drafting table is that it is collapsible such that five such collapsed drafting tables occupy approximately the space of one open drafting table according to the present invention. It is a particular advantage that the present drafting table is not disassembled for collapsing or closing. These and other features and advantages will be apparent from the following description.

SUMMARY OF THE INVENTION

Briefly the present invention is made up essentially of a generally vertical front panel attached to two vertical side panels which are spaced apart by and rigidly attached to said front panel. Extending rearward from the side panels are hinged sides. The vertical side panels each have an opposed vertical slot forward of the front panel along which the drafting top is adapted to travel to a position forward of the front panel, and the two hinged sides fold toward the front panel for closing the drafting table.

DETAILED DESCRIPTION OF THE INVENTION

Figures 1, 2, 3, 5:
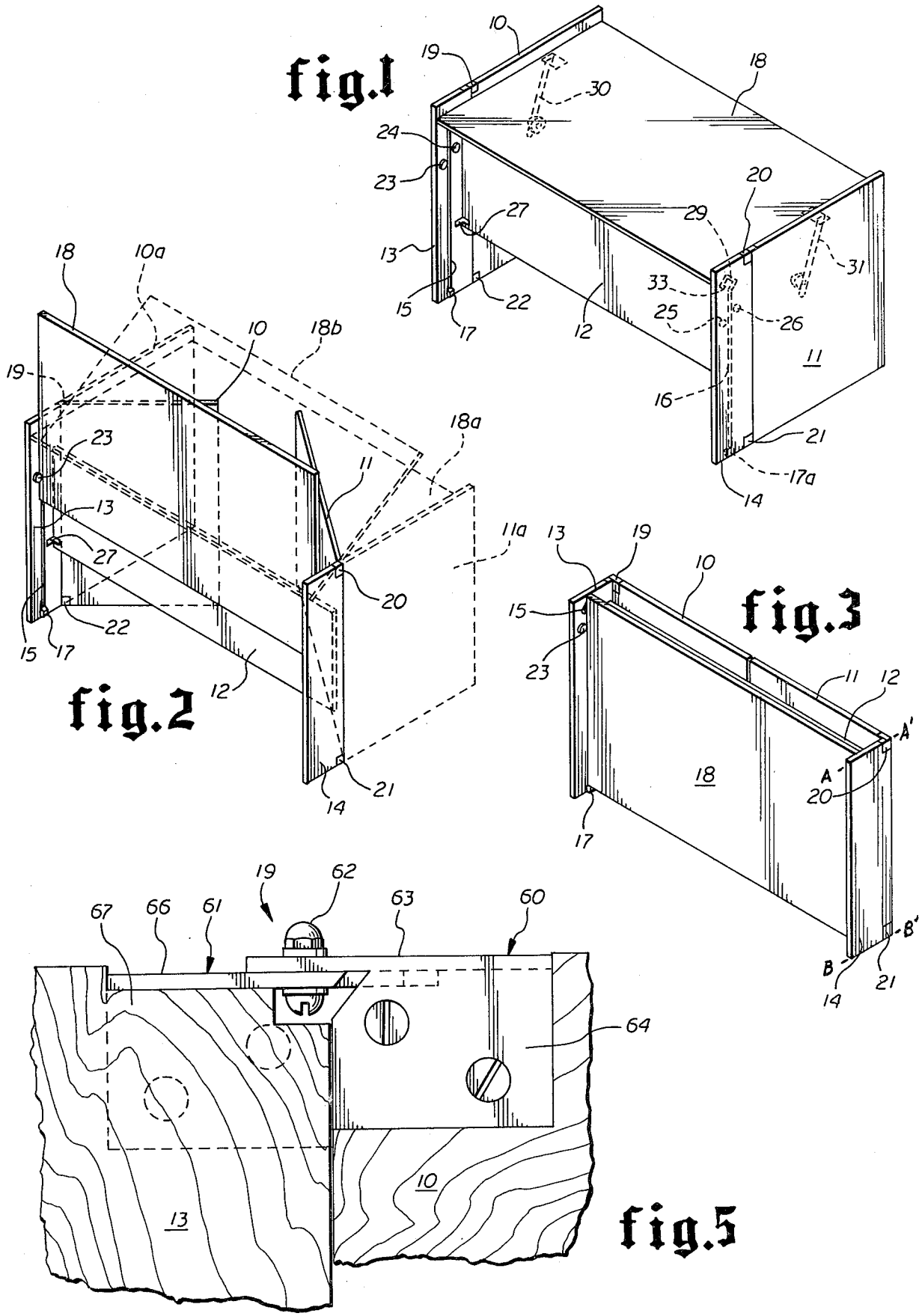
FIG. 1 is a perspective view of the drafting table set up for use.
FIG. 2 is a perspective view of the drafting table showing the set up and partially folded table.
FIG. 3 is a perspective view of the drafting table when folded.
FIG. 5 is a detail elevational view of a side panel hinge in place and extended (open).

Referring to FIG. 1, the drafting table is shown set up for use. The vertical front panel 12 has the vertical side panels 13 and 14 rigidly attached at each end for example, with "L" brackets 27. This structure, i.e., front panel 12 and side panels 13 and 14 can be viewed as the central core of the drafting table from which the other elements of the table are dependent.

Each vertical side panel 13 and 14 has a duplicate and opposed slot or channel 15 and 16 respectively therein forward of the front panel. The front panel 12 is attached adjacent to the rearward edge of each of the side panels. the slots 15 and 16 extend vertically and substantially parallel to the front panel. The upper end of the slots 15 and 16 extend above said front panel and form hook shaped ends (or some other offset structure) 28 and 29 respectively.

Figure 8:
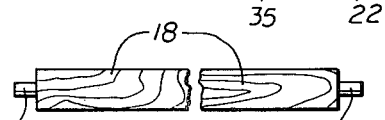
FIG. 8 is a detail of the drafting top partial front view.

The drafting top 18 is mounted to slots 15 and 16 by pins 32 and 33 respectively (FIGS. 4 and 8) and movable along the slots on the pins one at each end of the drafting top adjacent to the slots. Also the drafting top can rotate or pivot about said pins when seated in the offsets 28 and 29.

The pins 32 and 33 rest at the end of the hook shaped slot ends 28 and 29 when the table is set up for use.

Thus, slope adjusting means 30 and 31 (described in more detail in FIG. 4) can be used to raise or lower the rear portion of the drafting top 18 as it rests in the hook (offset) of the slots, to obtain the desired work surface slope.

Extending rearward from each of the side panels 13 and 14 are hinged side members or panels 10 and 11 respectively. The hinges 19, 20, 21 and 22 allow the side members 10 and 11 to extend linearly from the vertical side panels but not beyond the plane of the vertical side panels (vertical plane as defined by AA'BB', FIG.3) and to fold inwardly toward the front panel 12.

The slope adjusting means 30 and 31 are releasably attached to the side members 10 and 11 respectively for adjusting the drafting top. Adjacent to the slots 15 and 16 are guides pairs 23 and 24 and 25 and 26 respectively. The guide pairs serve to guide and hold the drafting top 18 as it is moved down the slots as shown in FIG. 2, since the only means engaging the top to the slot are the two pins 32 and 33.

FIG. 2 shows the closing operation or procedure to obtain the closed configuration of the drafting table shown in FIG. 3.

Figure 4:
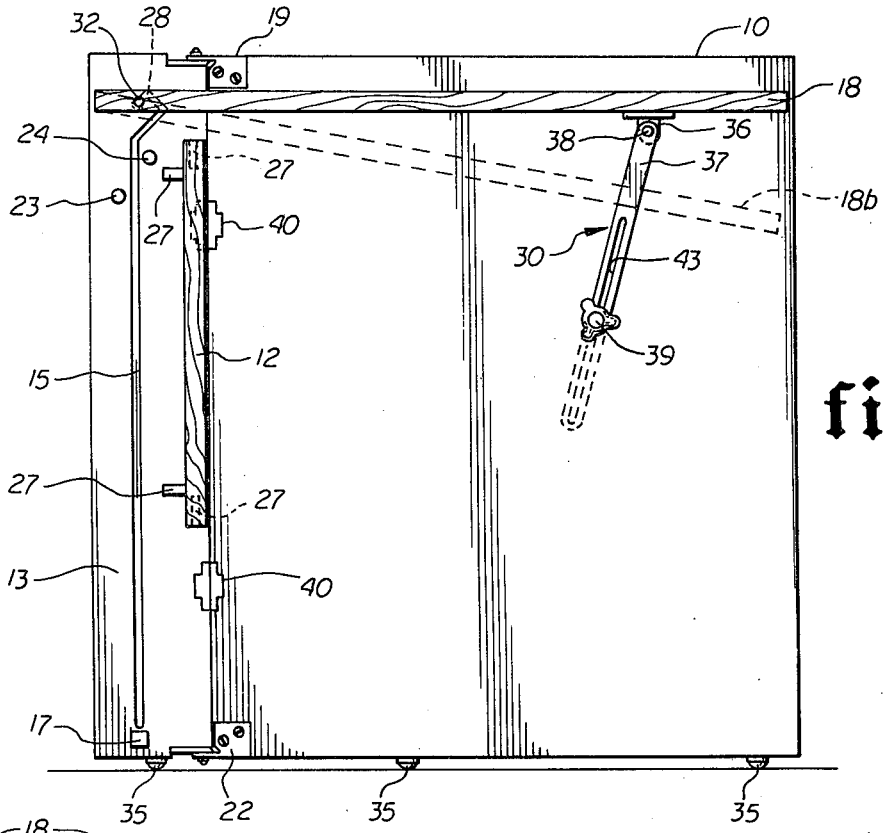
FIG. 4 is a cross sectional side elevation of the drafting table set up for use.
Figure 9:
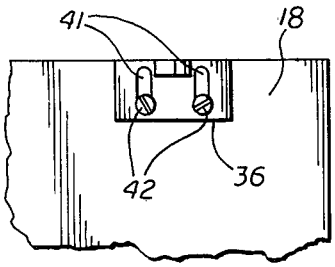
FIG. 9 is a detail of the slope adjusting means bracket attached to the drafting top view from below.

Referring to FIG. 4 the attachment of the drafting top 18 to the slope adjusting means 30 is shown. A bracket 36 is attached to the underside of drafting top 18 by screws 40 in slots 41 (FIG. 9). A slotted arm 37 is pivotally attached to bracket 36 by pin 38. A wing bolt 39 extends through slot 43 into a threaded seat (not shown) in side member 10. Wing bolt 39 is tightened against the arm 37 and side 10 to hold the drafting top in the selected position for example, the slope shown by dotted lines 18*d*. The same arrangement is used on the other side member 11 to obtain a solid surface. The various vertical elements of the drafting table that abut the floor surface are conveniently supported on casters 35.

To release the drafting top for closing of the drafting table, the wing bolt 39 is withdrawn from the seat in side member 10 (similarly for side member 11). The screws 42 are loosened and the bracket 36 moved along slots 42 in the direction of the arrow in FIG. 9 and the screws retightened. By relocating the bracket 36, it will clear guides 23 and 24 in the closing procedure.

To close the drafting table, the now freed drafting top 18 (which is attached to the remainder of the table only by pins 32 and 33 in slots 15 and 16 respectively) is moved along the slots 15 and 16 on pins 32 and 33. The guide pairs 23 and 24 and 25 and 26 are on opposide sides of the respective slots.

In FIG. 2, the closing of the table is shown when the drafting top 18 has moved on pins 32 and 33 in slots 15 and 16 to a vertical position forward of the front panel 12. The progression of top 18 from the open use position, dotted lines 18*a*, and the raised top 18*b* is illustrated. The top 18 is allowed to travel down the slots between guides 23 and 24 on side panel 13 and guides 25 and 26 on side panel 14. The top comes to rest against stops 17 and 17*a*.

The slope adjusting structure, i.e., bracket 36, pin 38 and arm 37 hangs from drafting top in the space between the closed drafting top and the front panel 12.

With the drafting top seated as described above on stops 17 and 17*a* the hinged side members 10 and 11 are now free to fold forward toward the front panel 12 shown in the original position by dotted lines 11*a* and 10*a*.

The hinges 19, 20, 21 and 22 are novel hinges, which will be described shortly (re FIGS. 5, 6 and 7) and act to prevent the opened or unfolded side members 10 and 11 from pivoting beyond the plane of the side panels 13 and 14. In addition to hinges 19, 20, 21 and 22 other hinges, such as, the recessed Soss hinges 40 may be used to connect the side panels and the side members.

When the side members 10 and 11 are entirely folded into the closed position they preferably rest against the rear side of the front panel 12. In the preferred embodiment the side members are about one-half the length of the front panel so that when closed the edges form a closure. Similarly, the size of the drafting top 18 is, preferably, such that when it is in the closed position (FIG. 3) it fits within the overall dimensions of the side panels so as to end at the same point, thus resultant folded drafting table is a very compact and uniform package for storage and/or transportation.

FIG. 5 shows hinge 19 in enlarged detail. A first hinge flange 60 is mounted to side member 10 and second hinge flange 61 is mounted opposed to the first hinge flange on vertical side panel 13 (on the reverse side from first hinge flange and shown by the dotted line). The two hinge flanges are joined by a pin, in this case a screw with nut 62, through the slotted openings 65 and 68 which are located in a first planar component 63 and 66 of the first hinge flange 60 and second hinge flange 61, respectively (FIGS. 6 and 7).

Each hinge flange has a generally L shaped cross section. The first planar components 63 and 66 are perpendicular to second planar components 63 and 67, respectively of each hinge flange.

Figure 6:
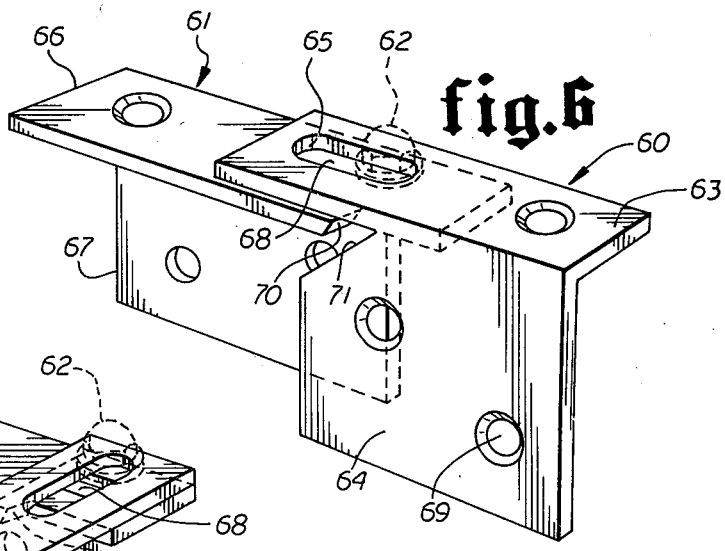
FIG. 6 is a perspective view of the hinge of FIG. 5 in the extended position.

As shown in FIG. 6 the two hinge flanges 60 and 61 are extendable along common axes, that is, the planar components are aligned in the same direction and are parallel, and the slots are in operable alignment and engaged by pin (bolt) 62. The two hinge flanges are pivotally and slidably engaged together by the pin 62. In the extended configuration as shown in FIG. 5, the first planar component 66 of second hinge flange 61 abuts the inner surface of the second hinge component 64 of the first hinge flange 60. The cut out 70 in component 66 allows the hinge to be straight, i.e., the cut out is equivalent to the thickness of second flange component 64. The abutment of the first planar component 66 of flange 61 against second planar component of flange 64, prevents further rotation of the hinge flanges beyond that point, i.e., in this use of the hinge, the side member of the drafting table is fully extended and planar with the vertical side panel to which is hinged.

Figure 7:
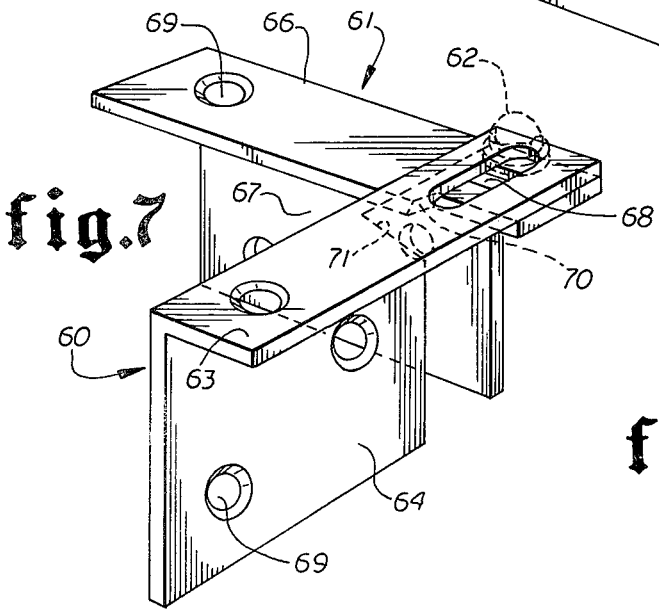
FIG. 7 is a perspective view of the hinge of FIG. 5 in the closed position.

The hinge flange 60 can be rotated to the position shown in FIG. 7 and the cut out 71 on second planar component 64 is provided to allow this rotation to 90° without the binding of the second planar component 64 of the first hinge flange and first planar component 66 of the second hinge flange. In the configuration shown in FIG. 7, the side member of the drafting table, for example 10, is in the closed position as shown in FIG. 3. Each of the planar components is equipped with holes 69 for attachment to the members of the drafting table with screws, bolts or the like.

The invention claimed is:

1. A foldable drafting table comprising:

(a) front member, (b) two first side members, rigidly attached to and spaced apart by said front member, (c) two opposed slots, one in each of said first side members, forward of said front member, and extending above said front member, (d) two second side members, one each hingedly attached to each of said first side members and extendable rearward from said front member, and foldable toward said front member, (e) a drafting top for extension between said first and second side members, (f) pin means attached to said drafting top at one end thereof to seat in said slots for movement of said drafting top along said slots into a position forward of said front member and between said two first side members for storage, and (g) means for releasably attaching said drafting top between and to said second side members and for adjusting the slope of said drafting top, by pivoting said drafting top about said pin means, each of said slots being provided at the upper end thereof with an offset in which to rest said pins attached to said top when said top is in an open configuration for use.

2. The drafting table according to claim 1 wherein said first side member are smaller than said second side members.

3. The drafting table according to claim 2 wherein said first side members are substantially the same size and said second side members are substantially the same size.

4. The drafting table according to claim 3 wherein each of said second side members has a length equal to about one-half the space between said first side members.

5. The drafting table according to claim 1 wherein means are provided whereby said second side members are not extendable beyond the vertical plane of said first side members to which said second members are respectively attached.

6. The drafting table according to claim 1 wherein said front member, said first side members and said second side members are panels.

7. The drafting table according to claim 1 wherein guide means are provided adjacent to said slots to guide and hold said drafting top during movement into position for storage.

* * * * *